United States Patent [19]

Weskamp et al.

[11] 4,421,604

[45] Dec. 20, 1983

[54] PROCEDURE TO CONTROL QUALITY OF COAL

[75] Inventors: Wilhelm Weskamp, Wattenscheid; Gerd Nashan, Oberhausen; Wilhelm Stewen, Dortmund, all of Fed. Rep. of Germany

[73] Assignee: Ruhrkohle Aktiengesellschaft, Essen, Fed. Rep. of Germany

[21] Appl. No.: 314,259

[22] Filed: Oct. 23, 1981

[30] Foreign Application Priority Data

Oct. 25, 1980 [DE] Fed. Rep. of Germany ..... 3040331

[51] Int. Cl.[3] ..... C10B 47/06; C10B 47/28; C10B 57/06; C10B 57/10

[52] U.S. Cl. ..... 201/1; 201/23; 201/44

[58] Field of Search ..... 201/1, 21, 23, 44

[56] References Cited

U.S. PATENT DOCUMENTS 3,607,660 9/1971 Kumper ..... 201/1
3,970,523 7/1976 Beck et al. ..... 201/1
4,053,569 10/1977 Hahn ..... 201/21
4,234,387 11/1980 Nandi et al. ..... 201/23
4,240,877 12/1980 Stahlherm et al. ..... 201/1
4,344,769 8/1982 Puff et al. ..... 201/23

FOREIGN PATENT DOCUMENTS 51-56801 5/1976 Japan ..... 201/1

*Primary Examiner*—Bradley Garris
*Attorney, Agent, or Firm*—Jon M. Lewis

[57] ABSTRACT

The quality of coke is improved by measuring the width of a plastic zone of a given type of coal, comparing said measured zone with a predetermined zone width known to result in good quality coke, adjusting certain characteristics of said given coal prior to charging it into the coke oven to cause a change in said zone width of the coal that will ultimately result in improved coke quality. Typical adjusting steps include preheating the coal and/or the addition of coal binders, such as, various carbon and petro-based binding agents, for example, pitch.

11 Claims, 1 Drawing Figure

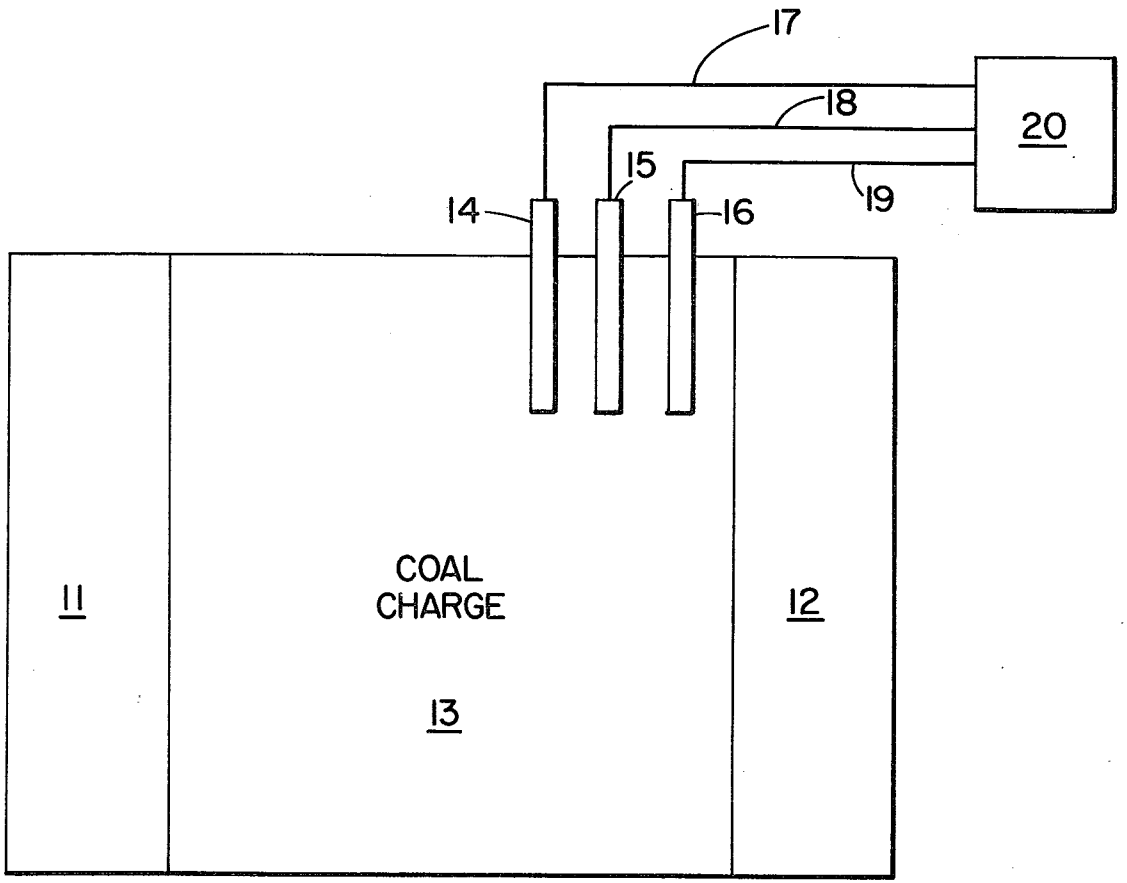
20
17
18
19
16
15
14
12
COAL
CHARGE
13
11

PROCEDURE TO CONTROL QUALITY OF COAL

FOREIGN PRIORITY

Priority is claimed under 35 U.S.C. 119 and based on German Patent Application No. P 30 40 331.7 filed on Oct. 25, 1980.

FIELD OF THE INVENTION

This invention relates to a process for controlling and thereby improving the quality of coke produced from a coking coal contained in coking charge mixture.

BACKGROUND OF THE INVENTION

Coking ovens are fed with coal in the form of a coking charge. A coking charge mixture is commonly used for coking, i.e. the coking coal is ground to obtain a certain granulate, having specific and various sizes of granules. The different sizes of granules, when mixed, give a certain distribution or spectrum of granule sizes. This distribution of sizes decisively influence the bulk density of coking coal in a coke oven by affecting the packing of the coal granules in the oven. It has been found that an optimum of distribution in granulates may be achieved by mixing different sizes of granules.

Of even greater influence than bulk density, on the quality of the coke produced, is the composition of the coking coal used in the charge mixture. Different test methods have been developed in order to make attempts to evaluate the coking behavior of coal in advance. Important properties result from the coal's mineral structure (type of coal, from what type of veins it comes), chemical composition (analytical chemical composition, ash content, content of volatile components, bitumen content, state of oxidation), and the coal's physical and/or chemical properties (behavior during softening, swelling, shrinking, expansion and degasification).

Importance is also placed upon the caking properties of coal. Caking capability is the ability of coal, when heated in a vessel which permits the coal to expand freely in a plastic state and then heated further, to form a caked lump of coal. A coal having good caking capability yields not only caked coke but also molten coke. This defined caking capability may be measured either by a swelling index or by a caking number according to ROGA.

Coals having good caking capability may ultimately produce, due to operational conditions in the coke oven, coke of lower quality than coke produced from coal with lower caking capability. Therefore, the caking capability of coal is deemed to be important in retrospect. The coking capability of coal may be determined either by dilatometer testing to determine expansion or by ascertaining the Gray-King type of coke produced. As known in the prior art, determination made in the dilatation process comprises the measurement of the change of length of a conical briquette heated at the rate of 0.05° C./second.

Finally, measurement of plasticity has a certain significance. What is understood by plasticity of coal, for the purposes to the instant patent application, is the capability of the coal to assume a plastic state between the temperatures of about 320° and 550° C. The usual methods of measuring plasticity involve the use of modified rotary viscosimeters. The results of such testing is not truly the viscosity of the coal in the usual physical sense, but the measurement is influenced by the apparatus used and therefore includes the internal friction of the solid, liquid and gaseous phases, as well as the degree of plasticity of all three phases. Such measurements are usually made in laboratories. The same is true for the measurement of the degasification properties, pressure of expansion and shrinkage, which are also tests for the quality of coal to be charged into a coke oven. The many and varied tests, of which only a few have been discussed above, used to determine the quality of the charging coal and to predict the coke quality indicate that until the method of the present invention, the control of the quality of coal to obtain high quality coke was only possible with the use of multiple measurements which made such determination very complex and cumbersome and an especially difficult prospect.

It is an object of the present invention to simplify the ascertaining of the quality of the charging material. It is a further object of the present invention to modify the charging material to produce a high quality coke.

SUMMARY OF THE INVENTION

This invention generally relates to a control and monitoring technique for producing coke of good quality from coal. The technique comprises evaluation of the quality of the coal to be charged into the coke oven by measuring or determining the width of the plastic zone of the coal, comparing such width with a desired predetermined zone width that is known to produce good quality coke, and then adjusting the character and/or characteristics of the coal, to be charged into the coke oven, to bring about a change in the width of the plastic zone of the coal. Such adjustment will result in a new plastic zone that more nearly resembles the desired predetermined zone, than if, the adjustment had not been performed. Thus, coke quality is enhanced when the coal is ultimately charged into a coke oven and then heated to produce coke. Two effective adjustment techniques are preheating the coal prior to charging it into the oven and adding coal binders to the charge.

BRIEF DESCRIPTION OF THE DRAWING

The sole FIGURE schematically illustrates several thermocouples positioned in a coke oven for measuring the temperature of coal being coked in the oven. The output from the thermocouples is fed to a comparator for comparison with predetermined temperature values.

DETAILED DESCRIPTION OF THE INVENTION

This invention is based upon the premise that essential determinants for establishing coke quality are controlled by a common effect in a certain portion of the coking charge during the coking process. This portion of the coking charge is known as the plastic range. This plastic range is apparent during observation of the coking process of mineral coal in indirectly fired horizontal chamber ovens. Such ovens are commonly known as by-product coke ovens.

Gases usable for fuel in the heating of the process which develop during the coking process are burned in the flues adjacent to the furnace. The heat of the adjacent flues is then transferred through the furnace walls to the charge, i.e. the charge mixture. Because of the indirect heating from two sides, temperature gradient fields having decreasing temperatures towards the center of the charge are created. Generally, the temperature contours or fields are symmetrical about the oven center line where the lowest temperature exists. With increasing coking time the temperature contour front moves from the wall towards the oven center, accompanied by a steep temperature gradient at the transition range which delineates already coked coal from unchanged charge coal. This transition range, in which all temperatures between 100°–1000° C. are passed through, is locally very narrow and occurs at the beginning of the coking process and extends for only a few millimeters of the approximately 450 millimeter wide oven chamber.

Step-wise coking of mineral coal takes place in the critical transition range wherein two essential temperature ranges have to be distinguished. The first temperature range is approximately between 320° and 480° C. In this temperature range the coal softens and a plastic state forms. When passing through this temperature range, a plurality of decomposition and polymerization reactions occur whereby the prerequisites for integration of the plastic substances with component parts take place and the coke quality is predetermined by this action.

The second temperature range occurs during the re-solidifying of the oven charge which has a contraction maximum around 600° C. In this range, under further aromatization, the coke structure is formed.

The reactions in both temperature ranges are dependent upon the type of coal making up the charge and the granulate composition of the charge components. The type of coal and granulation are largely predetermined in the usual coking plant and therefore, are not readily controllable. This invention is based on the premise that the resulting coke quality is dependent on the operationing conditions in the coking process, the preparation of charge material and the use of active coking adjuvants or additives which are much more important than other considerations. This means, according to the invention, that decisive significance is attributed to the extent and uniformity of the reactions in these critical transition temperature ranges.

Determinative of the course of these vital reactions in the coking process is the temperature gradient in the charge. A high temperature gradient means a high rate or speed local heating, whereby reactions develop insufficiently or may even be skipped over altogether, depending on the conditions and kinetics of the particular reaction. This leads to substantial non-homogeneity in the reaction in the charge during the coking process and results in a non-homogeneous coke structure. Furthermore, under such conditions, there is insufficient time to generate sufficient quantities of the material in the plastic state for the fusion of inert particles, and to provide for the mass transport of the plastic material in order to provide for the encasing or surrounding of these particles to yield a good quality coke. The duration of the period of plasticity, which correlates clearly with the rate of heating, i.e. the period decreases with increasing heat-up rate. That is, as the heating becomes more rapid, the time which the appropriate portion of the charge assumes a plastic state decreases. Such a resulting short period of heating, is too short to yield a good quality coke.

If a high temperature gradient occurs during the period after the period of time of the plastic state, which is called the post-plastic state or range, mechanical stress is increased in the charge material. This increased mechanical stress created by the high temperature gradient, which appears in the post-plastic range, leads to an increase in the incidence of crack formation. Such increased incidence of crack formations results in the production of undesirable small pieces of coke which degrade the quality of the coke from a standpoint of size classification.

A relatively wide plastic zone is thus desirable during coking. A decrease of the temperature gradient leads to a desirably wider plastic zone, which can be obtained with the locally slower heating up of the charge. This wider plastic zone and slower heating extends the time of the plasticity period whereby bonding of the individual inert particles is promoted.

This bonding is important for good quality coke production, because the reactions in the coal during coking have more time to take place and effectively result in equilibra of reactions corresponding to the reaction kinetics of the chemical components.

Other, ancillary, reactions occur in the plastic zone. Bubbles are generated in the plastic zone because of the plasticity thereof which entrains gas generated therein. With increasing width of the plastic zone, and therefore, the increase of reactions in the process, that is, the reactions go towards their completion, the amount of gas generated in the bubbles formed in the plastic zone increases which thus increases the gas pressure therein.

There exists a relationship between the gas bubble size and the gas bubble pressure. This relationship between gas bubble size and pressure, for a certain granulate size, can be viewed in a first approximation as an approximately inversely proportional interrelationship. Increasing pressure causes smaller gas bubbles which lead to smaller resulting coke pore diameter or size. This behavior of gaseous products of decomposition reflects the influence of granulate size upon the property of the swelling of the granules and the resulting fusion of surrounding particles. Moreover, increasing the width of the plastic zone increases the diffusion paths of the released gases. Subsequently, gas pressure is maintained over a longer time period which permits greater diffusion throughout the material in the plastic zone which in turn, leads to a greater homogeneity in gas bubble distribution, such as described during the formation thereof, supra, and can thus lead to yet further reactions of the products of gaseous decomposition.

Based upon the above hypothesis, the quality of the coke produced from the charge, according to the invention, is controlled in such a way that, during coking, certain actions are taken. The plastic range or zone is measured during the process, and if such range falls below a certain width, corrective measures are initiated. These corrective actions include one or more of the following, either singly or in combinations: (1) the adjustment of the temperature, (2) the addition of preheated coal; (3) carbon-based binding agents; and (4) petro-based binding agents.

In accordance with the above, Table I illustrates predetermined plastic zone widths and locations, at given coking times, that are considered to be teachings according to the invention, to produce coke of improved quality over prior art methods which do not adjust these parameters.

TABLE 1

| Coking Time (Hours) | Plastic Zone Width Minimum (mm) | Minimum Distance from Coke Oven Wall having at least a temperature of 320° C. (mm) |
|---|---|---|
| 1 | 2.2 | 18 |

TABLE 1-continued

| Coking Time (Hours) | Plastic Zone Width Minimum (mm) | Minimum Distance from Coke Oven Wall having at least a temperature of 320° C. (mm) |
|---|---|---|
| 1.5 | 3.7 | |
| 2 | 5.0 | 40 |
| 2.5 | 6.4 | |
| 3 | 8.0 | 64 |
| 3.5 | 9.2 | |
| 4 | 10.8 | 84 |
| 4.5 | 12.3 | |
| 5 | 13.5 | 108 |
| 5.5 | 15.0 | |
| 6 | 16.2 | 130 |
| 6.5 | 17.6 | |
| 7 | 18.9 | 148 |
| 7.5 | 20.0 | |
| 8 | 20.9 | 167 |
| 8.5 | 21.3 | |
| 9 | 21.5 | 187 |
| 9.5 | 21.6 | |
| 10 | 21.8 | 206 |

By way of further explanation of Table I, it is pointed out that the plastic zone width minimum, as shown, is the minimum required size of plastic zone width that is needed to obtain good or improved quality coke. Should zone widths below such minimums be obtained yet further corrective measures such as described herein must be taken.

While there is no currently known accurate mathematical relationship to relate coke quality to zone width, the experimentally determined relationship set forth in Table I is believed to constitute an experimental relationship which is, as a first assumption or approximation, independent of the actual coal mixture.

It is pointed out, however, that there is a large variation in such temperature fields or contours depending upon the coal used, for example, for wet and preheated coals. There is, as mentioned previously, a minimum plastic zone for all temperatures and also a minimum temperature for the plastic zone at which softening of the coal mixture commences. It should also be noted that in Table I, the optimum zone width changes during different periods of the coking time according to the minimum width of the plastic zone.

In accordance with the invention, the width of the plastic zone is the decisive factor for determining the coke quality. Measurement of this factor enables one to make an exact prediction of the resultant coke quality. Therefore, this width is used as the central control factor for the preparation and selection of the charge components, the coking process routine, and serves as a target value or factor for determining beforehand the resulting coke quality.

With the addition of carbon-based and/or petro-based binders, according to this invention, the softening temperature of the oven charge, at which softening occurs, is decreased. However, the temperature, at which resolidification occurs is not changed appreciably. Therefore, a wider range is created in which a plastic zone can exist. This results in a three dimensional expansion of the plastic zone, so that the above discussed substantial effects of the duration of plasticity, completeness, routine or sequence of reaction, gas bubble size, and homogeneity of gas bubble distribution becomes greater, more desirable and effectively more pronounced in the process. Typical additives include carbon-pitch or petro-pitch. The term pitch is intended to include carbon or petro-based substances. Petro-pitch is also called bitumen.

The addition of preheated coal, according to this invention, also brings a reduction of the temperature gradient in the charge, which results in a widening of the plastic range as a function of the dependence of the distance to the chamber wall whereby this effect gains significance as coking time increases.

The lower speed of heating or heating rate connected with a lower temperature gradient is also of greater importance in the post-plastic phase which has a contraction maximum at about 600° C. A lower temperature gradient reduces the mechanical stress in the charge, which decreases the tendency for crack formation. This improvement is reflected in greater production quantities of blast furnace quality coke. The abrasion resistance (M10) and lump strength (M40) are also increased. The mean pore diameter in coke becomes substantially smaller and the mean wall thickness of the cell wall surrounding the gas bubble in the structure of the resulting coke is increased.

The proportion of the mixture of coal and pitches will vary with the type of coal. A typical combination comprises a mixture of German Gasflame coal (36% WAF) and German Esscoal (16% WAF), to which was added from 5 to 15 wt. % of a carbon-based pitch binder having a softening point of 70° C. to 190° C. Many other combinations are possible and such combinations serve to influence the width of the plastic zone with the result that improved coke quality is obtained.

In accordance with the invention, the width of the plastic range is measured by means of the temperature distribution in the oven charge. This requires that temperature measurements are taken in relatively close increments from chamber wall towards the chamber center. The resulting temperature values are compared with theoretical temperature values which determine the minimum width of the plastic range. If these measurements indicate that the charge is falling below the specified desired temperature, subsequent charges must have added thereto coal binders and/or preheated coal additives until the desired temperatures are reached in the oven, that is, the minimum desired temperatures. Corresponding to the changing plastic range during the coking process, the limit values of the plastic range have to be kept according to the respective desired temperature in each phase of the coking process in other portions of the oven charge-cross section. The desired temperature can remain constant and show a value between 320° and 480° C. Preferably, a value near the lower temperature limit is chosen.

Control of the coke quality can be held closer to the desired norm and made more accurate, the more frequently the plastic range is measured during the coking process. According to the invention, particular accuracy can be achieved with at least two measurements at time differences of at least one hour. The temperature measurements are therefore made not only in spatial relationship, but also, at time intervals.

The spatial intervals can be utilized by a discrete number of temperature measuring units distributed over the oven chamber width or alternatively, by means of a unit which can be moved back and forth over the oven chamber width. Thermocouple-elements can be used as temperature measuring units, which preferably are covered with protective shield tubes which may be inserted, prior to coking, into the oven charge. A suitable material for the protective pipes such as Incoloy results in a longer service life.

Output signals from the thermocouple-elements can be passed into an electric comparator circuit having setting means, e.g. a potentiometer. The differential in voltage can be taken as a value measuring the need for the the addition of preheated coal and/or desired coal binders.

The sole FIGURE illustrates temperature measuring apparatus suitable for determining the plastic zone during the transformation of coal into coke in a coking oven. The FIGURE shows a cross-sectional view of a typical coke oven chamber 13 containing a charge of coal which is indirectly heated by flues 11 and 12. The output of thermocouple units 14, 15 and 16 from selected locations along the width of the coke oven in a three dimensional spacing, is transmitted to a comparator 20 by leads 17, 18 and 19 respectively. The comparator 20 compares the temperature of the thermocouple locations with preselected data in such a manner as to result in a comparison of the actual and a preselected plastic zone width. The comparative information is then utilized to adjust the characteristics of successive coal charges in accordance with the teachings of the invention. It is pointed out that exceeding the desired values, according to this invention, is substantially harmless within the known limits infra because the addition of preheated coal and desirable coal binders results only in a limited plastic zone. This limit for the addition of preheated coal is caused by the maximum preheating temperature of 250° C. available. The limit of coal binders stems from the maximum admixture which should not exceed a specific ratio of coal substance to amount of plastifying additives in consideration of the coke quality.

The principles and operating mode of the invention will be further apparent to those skilled in the art from following examples and other explanatory information. Normally each new charge mixture is tested in an experimental furnace prior to large scale production. In this way, for example, coking tests are run in 350 kg experimental furnaces with a charge consisting of 67% of a German Gasflame coal (36% WAF) and 33% forging quality coal (16% WAF) before the actual charging of the coke ovens in the coking plant. The experimental oven simulates the operational one and has typically an overall width of 340 mm.

The use of the invention on a technical scale prior to actual production is preferred because of the obvious economics involved in such procedure. Such use permits a determination of an optimized character of the charge mixture with respect to obtaining good quality coke. The technique of the invention has identified a direct parameter of coking quality, its plastic zone width during processing, and any change therein is a very sensitive indicator of the resulting coke quality. Such a parameter involves a lower limit value that is related to the attainment of the desired quality. Such value, for example 320° C., is set at the beginning of the plasticity zone of the coal mixture in the coke oven under coking.

During the coking process, temperature changes of the oven charge run symmetrically towards the coke oven chamber centerline. Therefore, it is sufficient to measure at points between only one of the chamber walls and the over center. In the operational example, and referring to the FIGURE protective tubing is spaced at distances of 20 mm in the oven. The tubing extends from the top into the oven charge if the oven is filled. The tubing permits, during the coking process, insertion of thermocouple-elements and the taking of temperature measurements over half of the oven charge. Of course, measurements could be made over the entire expanse of the charge on both sides of the oven in accordance with the invention. Because of the nature of the process in a coke oven, measuring temperature in one half of the oven appears to be sufficient. However, in the spirit of the invention, measurements could be made on both sides.

During the first ten hours of the coking process, the temperature is preferably measured in hourly intervals at the prepared measuring points. The resulting actual measuring values are compared with the respective hourly desired values of temperature which have been predetermined to produce good quality coke. Other time intervals for the temperature measurements may also be chosen. At time intervals which are between pre-set half-hourly and hourly measurements, linear extrapolation can be used to refer these measurements to values between the pre-set desired values and the adjacent half-hourly and hourly temperature measurements.

The desired temperature for coking is in the range between 320° and 480° C. This means that the temperature reached in the oven section should be a minimum of 320° C. Depending on the point to which the coking process has progressed, that is after one, two, four etc. hours, the minimum measured temperature of the charge should have reached this minimum temperature. Exceeding this temperature is not detrimental. However, falling below the nominal temperature may produce a blast furnace coke of inferior quality which will not be a good grade of coke for this purpose.

Based on the assumption that there are two plastic zones formed at the beginning of the coking process, both of which, start at the oven walls and move towards one another during the coking process, the zones will meet at the center of the chamber at the end of the coking time. In the example, the desired temperature always is characterized in that the desired position of the advancing boundary of the plastic zone faces the chamber center. On the other boundary of the plastic zone facing the chamber wall, a higher temperature occurs because of the indirect nature of the heating. The temperature, of course falls off towards the chamber center. The temperature value used for monitoring of the process, according to the invention, in this exemplary embodiment, is measured at the border of the plastic zone facing the chamber center. In certain embodiments of the invention, the other boundary of the plastic zone can be used for monitoring purposes, as well. Then the desired temperature is 480° C. and the minimum distance from the chamber wall equals the minimum distance for a desired temperature of 320° C. minus the minimum width of the plastic zone predetermined in accordance with the invention.

The results obtained in the example after selected hours of coking time for the desired temperature of 320° C. are set forth for them in Table II:

TABLE II

| Coking Time (Hours) | Distance From Chamber Wall at T = 320° C.* Distance of Plastic Zone from Oven Wall for wet coal (mm) | Distance of Plastic Zone from Oven Wall for wet coal with 15% Pitch (mm) | Distance of Plastic Zone from Oven Wall with 50% Pre-heated coal (mm) | Desired Distance of Plastic Zone from Oven Wall (mm) |
|---|---|---|---|---|
| 1 | 2.5 | 9.5 | 22.0 | 18.0 |
| 2 | 14.0 | 25.0 | 46.0 | 40.0 |
| 3 | 35.0 | 48.0 | 65.0 | 64.0 |
| 4 | 60.0 | 69.0 | 81.0 | 84.0 |
| 5 | 78.0 | 90.0 | 109.0 | 108.0 |
| 6 | 104.0 | 114.0 | 122.0 | 130.0 |
| 7 | 128.0 | 136.0 | 144.0 | 148.0 |
| 8 | 145.0 | 156.0 | 164.0 | 167.0 |
| 9 | 162.0 | 172.0 | 187.0 | 187.0 |
| 10 | 184.0 | 190.0 | 215.0 | 206.0 |

*Accuracy of measurement 5 mm tolerance

As indicated in the example the measured distances when using wet charge mixtures deviate from minimum desired distances of above table as follows:

instead of 84 mm, only 60 mm after 4 hours;
instead of 130 mm, only 104 mm after 6 hours;
instead of 167 mm, only 145 mm after 8 hours; and
instead of 206 mm, only 184 mm after 10 hours.

According to the invention, the difference between minimum distances and desired distances can be lessened, for example, by adding carbo-bitumen and/or pre-heated coal. The addition of carbo-bitumen results in a maximum reduction of 0.5–0.8 mm of the difference for each percent of carbo-bitumen added. This can be based on an upper limit of about 15% carbo-bitumen. Above the 15% limit the coke quality is degraded because the amount of plastic components becomes too large in relation to the remaining carbon structure.

If a carbo-based binder, such as pitch, is added, the minimum distances are modified. The example with the coking time intervals of 4, 6, 8, and 10 hours following the approximation to the predetermined minimum distances of the 320° C. limit values could be reached by adding 15% by weight, of a carbo-based binder such as pitch or the like, resulting in changes of the distances:

instead of 60 mm after 4 hours, 69 mm;
instead of 104 mm after 6 hours; 114 mm;
instead of 145 mm after 8 hours; 156 mm; and
instead of 184 mm after 10 hours; 190 mm.

The deviation of these differences from the minimum distances desired for for achieving the pre-set desired values can be diminished by the addition of of preheated coal to the charge. In the example, due to economic considerations, only preheated coal was added instead of carbo-bitumen. The addition of preheated coal brings, on the average, about approximately 4 mm per 10% addition of preheated coal at a preheating temperature of 220° C. This relationship is generally valid for all preheating temperatures above 200° C. Below 200° C. there are slight deviations due to the stronger dependance of bulk density on the preheating temperature.

According to the above stated rough calculation, the addition of 50% coal preheated to 220° C. already brings the desired distances during continuous temperature measurement. If the whole charge is preheated, a sufficient quality effect is easily ensured.

The predetermined desired values, according to this invention, are not only valid for the charge coal of the example but also are valid for other charge coals and charge mixtures, because the influence of thermal conductivity of the charge material is insignificant for the pattern of the temperature fields.

The examples given of the invention hereinabove to describe the method are preferred examples only; the invention is not to be taken as limited to all the details of the described embodiments, since further modifications and variations of the invention may be made without departing from the spirit or scope of the invention.

What is claimed:

1. A method for producing coke of a desired quality from coal in a coking cycle, comprising the steps of:

charging a portion of said coal into a coke oven;

obtaining temperature measurements of the portion of said coal charged into a coke oven during the coking cycle of said coal, said temperature measurements being taken incrementally from the coke oven chamber wall towards the center of said oven chamber;

determining a temperature contour of the portion of said coal charge during the coking cycle of said charge, said temperature contour being based on said incremental temperature measurements;

measuring the width of a plastic zone in said coal as reflected in said temperature contour;

comparing said measured plastic zone width with a predetermined plastic zone width that is known to result in the production of coke of a desired quality;

adjusting at least one characteristic of a further portion of said coal so as to result in a change in the width of the plastic zone of said coal when said further portion is charged into the coke oven, said adjustment resulting in a plastic zone, having a width that more nearly resembles said predetermined plastic zone width;

charging said adjusted further portion of coal into the coke oven; and heating said adjusted further portion of charged coke to produce coke of the desired quality.

2. The method of claim 1, wherein the step of adjusting said at least one characteristic of said coal is performed by preheating the further portion of coal to a temperature no more than about 250° C. prior to charging into the coke oven.

3. The method of claim 1 wherein the step of adjusting said at least one characteristic of the further portion of coal is performed by the addition of up to 15 percent by weight of a coal binder.

4. The method of claim 3, wherein the coal binder is a member selected from the group consisting of petro-based binders, carbon-based binders, and mixtures thereof.

5. The method of claim 1, wherein at least two temperature measurements spaced apart in time at least one hour are taken.

6. The method of claim 1 or 5, wherein the temperature measurements are taken along the width of a coke oven in a three dimensional spacing.

7. The method of claim 6, wherein the temperature is measured with a thermocouple.

8. The method of claim 1, wherein the width of the plastic zone is measured by determining the width of a portion of the initial charge of coal that has a temperature in excess of a certain minimum temperature.

9. The method of claim 8, wherein the minimum temperature is at least about 320° C.

10. The method of claim 9, wherein the minimum temperature is between about 320° and 480° C.

11. The method of claim 1, wherein said predetermined plastic zone width substantially corresponds to the following schedule:

| Coking Time (Hours) | Plastic Zone Width Minimum (mm) | Minimum Distance from Coke Oven Wall having at least a temperature of 320° C. (mm) |
|---|---|---|
| 1 | 2.2 | 18 |
| 1.5 | 3.7 | |
| 2 | 5.0 | 40 |
| 2.5 | 6.4 | |
| 3 | 8.0 | 64 |
| 3.5 | 9.2 | |
| 4 | 10.8 | 84 |
| 4.5 | 12.3 | |
| 5 | 13.5 | 108 |
| 5.5 | 15.0 | |
| 6 | 16.2 | 130 |
| 6.5 | 17.6 | |
| 7 | 18.9 | 148 |
| 7.5 | 20.0 | |
| 8 | 20.9 | 167 |
| 8.5 | 21.3 | |
| 9 | 21.5 | 187 |
| 9.5 | 21.6 | |
| 10 | 21.8 | 206 |

* * * * *